US010508522B2

(12) United States Patent
Johnson et al.

(10) Patent No.: US 10,508,522 B2
(45) Date of Patent: Dec. 17, 2019

(54) AUTOMATIC SUCKER ROD SPACING DEVICE AND METHODS OF USING SAME

(71) Applicant: TRC Services, Inc., The Woodlands, TX (US)

(72) Inventors: Michael Eric Johnson, The Woodlands, TX (US); Donald Ewing, Big Spring, TX (US); Donald Mike Johnson, The Woodlands, TX (US); Joe Boyd, Midland, TX (US); Danny Uselton, The Woodlands, TX (US)

(73) Assignee: TRC Services, Inc., The Woodlands, TX (US)

( * ) Notice: Subject to any disclaimer, the term of this patent is extended or adjusted under 35 U.S.C. 154(b) by 180 days.

(21) Appl. No.: 15/411,220

(22) Filed: Jan. 20, 2017

(65) Prior Publication Data

US 2017/0211365 A1 Jul. 27, 2017

Related U.S. Application Data

(60) Provisional application No. 62/288,913, filed on Jan. 29, 2016, provisional application No. 62/287,784, filed on Jan. 27, 2016, provisional application No. 62/286,170, filed on Jan. 22, 2016.

(51) Int. Cl.

| | |
|---|---|
| ***E21B 19/02*** | (2006.01) |
| ***E21B 19/08*** | (2006.01) |
| ***E21B 44/02*** | (2006.01) |
| ***E21B 43/12*** | (2006.01) |
| ***E21B 41/00*** | (2006.01) |
| ***E21B 47/00*** | (2012.01) |

(52) U.S. Cl.
CPC ..... *E21B 43/127* (2013.01); *E21B 41/0092* (2013.01); *E21B 47/0008* (2013.01)

(58) Field of Classification Search
CPC ..... E21B 17/00; E21B 19/02; E21B 19/081; E21B 19/08; E21B 44/02; E21B 43/127
See application file for complete search history.

(56) References Cited

U.S. PATENT DOCUMENTS

| | | | |
|---|---|---|---|
| 2,038,527 | A | 12/1935 | Eaton |
| 2,530,055 | A | 11/1950 | Green |
| 2,925,266 | A | 2/1960 | McAllister |

(Continued)

FOREIGN PATENT DOCUMENTS

| | | | |
|---|---|---|---|
| CN | 2871802 | Y | 2/2007 |
| RU | 2532025 | C2 | 10/2014 |

OTHER PUBLICATIONS

International Search Report and Written Opinion dated Jun. 8, 2017, in International Application No. PCT/US17/14309.

(Continued)

*Primary Examiner* — Catherine Loikith
(74) *Attorney, Agent, or Firm* — Blank Rome, LLP

(57) ABSTRACT

An automated sucker rod spacing device comprising a housing, a screw set within the housing and connected to a sucker rod string via a polished rod, a nut which is in threaded engagement with the screw, a means to transmit a rotation force to the nut, wherein the rotation of the nut can lower or raise the screw and thus lower or raise the sucker rod string. The device can be used to stop tagging, ensure full pump fillage, and avoid gas lock.

34 Claims, 13 Drawing Sheets

(56) References Cited

U.S. PATENT DOCUMENTS

| | | | | |
|---|---|---|---|---|
| 3,320,820 | A | 5/1967 | Banks | |
| 3,363,475 | A | 1/1968 | Foster et al. | |
| 4,176,714 | A | 12/1979 | Case | |
| 4,354,395 | A | 10/1982 | Page, Jr. | |
| 4,445,674 | A | 5/1984 | Clayton, Jr. | |
| 4,454,778 | A | 6/1984 | Camren | |
| 4,462,759 | A | 7/1984 | McGeehee | |
| 4,604,724 | A * | 8/1986 | Shaginian | E21B 19/20 166/53 |
| 4,631,954 | A | 12/1986 | Mills | |
| 5,101,676 | A | 4/1992 | Collins | |
| 5,194,859 | A * | 3/1993 | Warren | E21B 47/011 175/45 |
| 5,970,794 | A | 10/1999 | Yoshida | |
| 6,810,953 | B2 | 11/2004 | Adoline | |
| 6,857,474 | B2 * | 2/2005 | Bramlett | E21B 47/0008 166/250.15 |
| 8,157,537 | B2 * | 4/2012 | Chavez Zapata | F04B 47/02 417/12 |
| 8,950,473 | B2 | 2/2015 | Smith | |
| 2005/0178540 | A1 | 8/2005 | Siewert | |
| 2008/0314581 | A1 | 12/2008 | Brown | |
| 2009/0055029 | A1 | 2/2009 | Roberson et al. | |
| 2014/0367514 | A1 | 12/2014 | Fradet | |
| 2015/0000930 | A1 | 1/2015 | Haarstad et al. | |
| 2015/0285041 | A1 * | 10/2015 | Dancek | E21B 43/126 417/46 |

OTHER PUBLICATIONS

International Preliminary Report on Patentability dated Aug. 2, 2018, in International Application No. PCT/US17/14309.

Pump Off Controllers and the Opportunity for Customers; Case Study New Mexico; Southwestern Public Service Corporation; Xcel Energy Corporation; May 2011.

Pump-Off Control (POC); http://home.myfielddata.com/Support/UserHelp/pump_off_control.html obtained Aug. 13, 2015.

Ray, Louis; Value of Rod Pump Control; eProduction Solutions, Inc., TWP-003 Rev. O., (Undated.).

* cited by examiner

AUTOMATIC SUCKER ROD SPACING DEVICE AND METHODS OF USING SAME

RELATED APPLICATIONS

This application claims priority to U.S. Provisional Patent Application Ser. No. 62/286,170, filed on Jan. 22, 2016; Ser. No. 62/287,784, filed on Jan. 27, 2016; and Ser. No. 62/288,913, filed on Jan. 29, 2016, which are specifically incorporated by reference in its entirety herein.

FIELD

The disclosure relates generally to the pumping of an oil well. The disclosure relates specifically to the devices for adjusting the length of sucker rod strings.

BACKGROUND

A pump jack system, which is known by several different names (beam pumping, pumping units, rocking horse, oil jack, jack pump, and many others) are above ground units that are used to drive for a reciprocating piston pump in an oil well that is located downhole in the bore of a subterranean formation. The pumping action is used to mechanically lift well bore fluids from the well bore to the surface. The pumping unit operates electrically, whether through standard power or gas generated powered prime mover which turns the crank and moves the pitman arms in a pivoting vertical motion. This motion moves the walking beam in proportion to the amount of adjustable movement of the pitman arms. The horsehead attaches to the walking beam over the well head. Suspended from the horsehead is the bridle. The polish rod has a polish rod clamp attached to it that holds the position of the rod string. The clamps sit on top of the carrier bar. The polish rod goes through the stuffing box and is attached to the rest of the subsurface rod string which is attached to the downhole pump. This positioning of the parts allows the mechanical vertical movement of the pumping unit to be transferred to the rod string and to the down pumping system. The process of creating the downhole motion of the pumping system can also be created by the use of a vertically mounted hydraulic pumping system. The hydraulic system, though different on the surface, creates the same motion to the downhole system.

The bottom of the well may be a considerable distance from the surface, necessitating the use of a string of sucker rods. The string length/stretch typically changes due to the level of fluid in the well, i.e., the buoyancy effect on the rods. In the course of each day, continually changing conditions affect the overall length of the string of sucker rods, causing the string to increase or decrease in the length. The change in the length is not entirely predictable. The sucker rods also tend to stretch under operating loads over long periods. Other considerations are that the required adjustment range increases with well depth.

In order to ensure full pump fillage and improve production efficiency, the pump stays in the same position in relation to the valve clearance. The pump's plunger should be as close to the bottom of the pump as possible to ensure maximum pump fillage. The pump should be present as close to the bottom of the well as possible, which may result in "the coupling that attaches the pull rod of the pump to the rod string contacting the top of the pump during the downstroke. This contact of the coupling and the top of the pump is known in the industry as tagging. This action of tagging causes many destructive effects. It increases the stress on the entire sucker rod string. It also causes the sucker rods to buckle and slap the inside of the tubing, which causes increased wear to the sucker rods and the tubing, and begins to start the fatigue process on the rod string. Therefore, a compensating adjustment is needed from time to time.

The pump used in connection with the sucker rods can undergo "gas lock". "Gas lock" occurs when gas enters the area below the plunger when the plunger is at the uppermost position of travel and while traveling to its lowermost position, cannot compress the gas sufficiently to force the traveling valve open. On the following upstroke, the gas expands and keeps the pressure high enough below the plunger so that the standing valve will not open and allow fluid to enter the pump. This compressing and expanding of gas repeats itself on each downstroke and upstroke without increasing pressure enough to open the traveling valve or decreasing pressure enough to allow the standing valve to open and allow fluid to enter the pump. The simple solution to this problem is to periodically adjust the stroking depth of the plunger in the pump by adjusting the rod string. The "lowering" of the rod string can create enough pressure inside the pump to force the valve to open. The lowering of the rod string can also be moved enough so that the coupling on the pull rod strikes the top of the pump. This causes vibration in the pump and may shake the traveling valve to allow the gas to escape into the tubing to reduce the "gas lock" condition.

To avoid damage to sucker rods and lost production, the depth of the sucker rod string in the well should be controlled by lowering or raising the sucker rod string to either stop gas lock or to prevent tagging. Tagging is prevented while at the same time maximum pump fillage is ensured because the plunger is fully engaged. There have been efforts to address this task, one approach outlined by Norman (U.S. Pat. No. 5,101,676) is to provide a sucker rod depth adjusting attachment which comprises a cross bar and supporting underslung solid piston rams on each side thereof. The upper piston ends of these rams abut a depth adjusting bar, which is adjustably positioned above the cross bar by extension or retraction of the ram.

There are currently only manual solutions for spacing the sucker rod string, i.e., lowering or raising the sucker rod string. The existing manual devices to space the sucker rod string are tedious and require someone to be onsite to make the adjustments. The manual devices are not designed to constantly monitor the position of the plunger and to make automatic adjustments to ensure complete pump fillage without tagging. In addition, by the time someone realizes that a sucker rod string is tagging and makes the adjustment, the damage to the equipment has likely already occurred.

There exists a need for a device to monitor and adjust the depth of a sucker rod string automatically.

SUMMARY

An embodiment of the disclosure is a device capable of automatically controlling the depth of the sucker rod string in a well by automatically lowering or raising the sucker rod string in reaction to certain measurements, wherein the device is above ground and is operationally connected to a string of sucker rods. In an embodiment, the device is operationally connected to a string of sucker rods by one selected from the group consisting of a polished rod and a sucker rod. In an embodiment, the device further comprises a sensor in a wellbore capable of communicating with a portion of the device located above ground. In an embodiment, the sensor is selected from the group consisting of load cells, motor sensors, pressure transducers, relays, accelerometers, and motor sensors. In an embodiment, the method of lowering or raising the sucker rod string is mechanical. In an embodiment, the mechanical method is selected from the group consisting of hydraulics, air pistons, and spooling of the bridle. In an embodiment, the device further comprises: a housing; a screw set within the housing and connected to a sucker rod string via a polished rod; a nut which is in threaded engagement with the screw; a means to transmit a rotation force to the nut; wherein the rotation of the nut can lower or raise the screw and thus lower or raise the sucker rod string. In an embodiment, the screw comprises a central axial bore; and a load support plate mounted on top of the screw, wherein the load support plate comprises a hole; wherein the polished rod extends up through the central axial bore and the hole of the load support plate; and wherein the polish rod is secured to the screw by a clamp positioned at the top of the load support plate. In an embodiment, the polished rod is attached to the lower end of the screw. In an embodiment, the means to transmit consists of one selected from the group consisting of a prime mover and a transmission mechanism. In an embodiment, the prime mover is selected from the group consisting an electric motor, a hydraulic motor, and an air cylinder. In an embodiment, the transmission mechanism is selected from the group consisting of a chain and a timing belt. In an embodiment, the device further comprises an automatic control system used to monitor and control the depth of the sucker rod string; wherein the automatic control system comprises a sensor to measure the operation of the sucker rod string and a computer to control the depth of the sucker rod string. In an embodiment, the sensor is selected from the group consisting of an accelerometer, a strain gauge, and a load cell. In an embodiment, the sensor receives and analyzes a signal to determine if a pump is tagging; wherein if the pump is tagging, the computer raises the sucker rod string to a level where there is not tagging. In an embodiment, the automatic control system periodically lowers the sucker rod string until a tag is detected and raises the sucker rod string to ensure a plunger of a pump is close to a bottom of a well. In an embodiment, the automatic control system periodically adjusts the depth of the sucker rod string to bump the bottom of the well to avoid gas lock. In an embodiment, the automatic control system communicates with the sensor over a communications network. In an embodiment, the communications network is selected from the group consisting of a Bluetooth integration and a SCADA compatible system.

An embodiment of the disclosure is an automated sucker rod spacing device comprising: a housing having a hole through which to couple a polished rod connected to a sucker rod string; a gate through which the polished rod is inserted; two screws set within the housing, each of which having a screw ear that attaches to a bridle on a horse head; two nuts which are in threaded engagement with the screws; a means to transmit a rotation force to the two nuts; wherein the rotation of the two nuts can lower or raise the two screws and thus lower or raise the sucker rod string. In an embodiment, the means to transmit consists of one selected from the group consisting of a prime mover and a transmission mechanism. In an embodiment, the prime mover is selected from one of the group consisting of an electric motor, a hydraulic motor, and an air cylinder. In an embodiment, the electric motor can be controlled by a variable frequency drive. In an embodiment, the transmission mechanism is selected from the group consisting of a chain and a timing belt.

An embodiment of the disclosure is a method of automatically controlling the depth of the sucker rod string in the well comprising utilizing the device. In an embodiment, the method further comprises logging data into reports. In an embodiment, the data is at least one selected from the group consisting of an initial position of the sucker rod string, a number of adjustments of the depth of a sucker rod string; a direction of each adjustment, a distance of each adjustment, a position of the sucker rod string being in adjustment, a last surface diagnostic card, and a last down hole diagnostic card. In an embodiment, the method further comprises interfacing the device with a pumping unit or a pump off controller to shut down the well when there is not enough fluid to pump. In an embodiment, the method further comprises utilizing a user interface to enter a production rod string and a pump to calculate an approximate production during a set time period. In an embodiment, the method further comprises shutting down a pump if one or more operating parameters are not met for a programmable period of time. In an embodiment, the method further comprises drawing a surface card and a downhole card; and identifying common cards to identify possible issues. In an embodiment, the method is integrated into a diagnostic software to export data and produce problem notification. In an embodiment, the method further comprises monitoring equipment; and producing logs, reports, and notification from a remote location. In an embodiment, the method further comprises utilizing an artificial intelligence system that can dynamically keep track of various parameters of the device, provide early indications of failures, and provide suggestions on types of maintenance work required. In an embodiment, the artificial intelligence system collects data from a pump off controller. In an embodiment, the data is at least one selected from the group consisting of card area, peak surface load, minimum surface load, strokes per minute, surface stroke length, flow line pressure, pump fillage, yesterday cycles, and daily run time.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3rd Edition.

Figure 9:
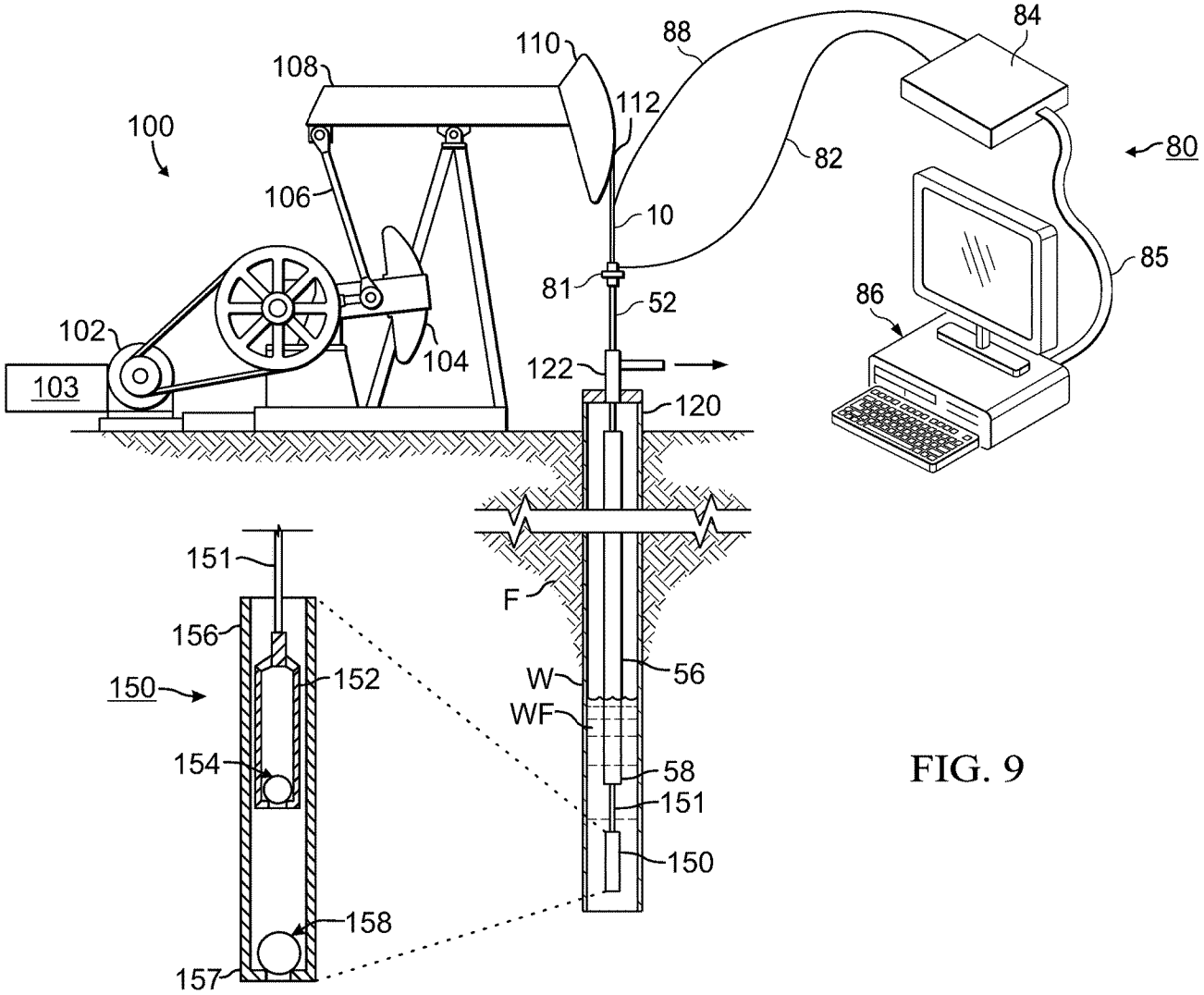
FIG. 9 is a schematic view of an automated sucker rod spacing device.

As used herein, the term "polished rod" refers to a piston that passes through the stuffing box (e.g., 122; FIG. 9).

The term "pump off controller" (e.g., 103; FIG. 9) refers to equipment that monitors pump conditions and based upon preset conditions, shuts down the pump unit (100; FIG. 9) for a preset period of time to allow entry of fluid into the well bore to optimize performance.

The term "pump fillage" refers to the quantity of fluid entering the pump on each stroke.

The automated sucker rod spacing device (10; FIGS. 1-9) monitors the position of a plunger (152; FIG. 9) of a downhole pump (150; FIG. 9) and makes automatic adjustments to ensure complete pump fillage without tagging. In an embodiment, the position of the plunger (152) is constantly monitored. In an embodiment, a portion of the device (10) is a replacement of the current universal carrier bar. It will have two long screws that will attach to the bridle on the horse's head (110; FIG. 9) and will be able to lower and/or retract the entire assembly in order to adjust the spacing of a sucker rod string (56; FIG. 9) manually or with a motor controlled by software or relays. Using an electrical motor (or another type of motion device), the central shaft will turn via a gearbox fed directly to the screw gears on the bottom of the device via chains, timing belts, or other connecting materials, in order to turn the screws in synchronization to move the tool in a level position. Using load cells, strain gauges, accelerometers (81; FIG. 9) or other such devices, data will be fed to an integrating computer (86; FIG. 9) that will do real-time modeling of what is happening with the sucker rod string downhole. A load cell is a transducer that creates an electrical signal whose magnitude is proportional to the force being measured. As the force measured increases, the computer (86) will trigger the motorized device (10) to raise the sucker rod string. A strain gauge will measure the strain on the sucker rod string. If there is increased strain on the sucker rod string, the computer (86) will trigger the motorized device (10) to lower the sucker rod string. An accelerometer is an electromechanical instrument that measures the acceleration of motion of a structure. The force caused by the change in motion compresses the piezoelectric material causing production of an electrical charge proportional to the charge exerted on the piezoelectric material. If there is increased force on the sucker rod string (56), the computer (86) will trigger the motorized device (10) to raise the sucker rod string (56). Based on different events encountered, the computer (86) will trigger the motorized device (10) to shorten or lengthen (raise/lower) the overall string (56), whichever is required for optimal production. The system (80; FIG. 9) will monitor the status of the string (56) in real-time and is capable of making multiple unattended adjustments within minutes. The mechanical movement can be performed using various methods, including but not limited to, equipment that spools or unspools the bridle to raise and lower the string, using hydraulics, and using air rams.

Referring to FIGS. 1-4, an automated sucker rod spacing device 10 includes a housing 30 and a screw 21 which is set within the housing 30. Anchored in the housing 30, a nut 40 is in threaded engagement with the screw 21, such that, as the nut 40 rotates, the screw 21 can move upwardly or downwardly. A thrust ball bearing 26 is located below the nut 40, while a screw support bearing 23 is located on the lower end of the screw 21. The thrust ball bearing 26 serves to help rotation and to support the nut 40 while the screw support bearing 23 serves to keep the screw 21 aligned. The nut 40 is advantageously located near the top of the screw 21 in its retracted position to make use of the full length of the screw 21. Cover 27 is present near screw 21. Top fastener 28 and side fastener 25 are present in relation to the housing 30. A motor 12 is provided to supply a rotational force to nut 40. Beneficial results have been obtained through the use of a bidirectional electric motor. Any kinds of electric motors including an AC motor or DC motor can be used. In an embodiment, the motor 12 is a three-phase induction motor coupled with a motor controller (not shown).

There are various means to transmit a rotation force of the motor 12 to the nut 40. In an illustrated embodiment, the motor 12 is coupled to a sprocket wheel 60 through a rotational reducer 14. The rotational reducer 14 is formed to reduce the rotational speed supplied by the motor 12 and deliver the reduced speed to the sprocket wheel 60. A sprocket wheel 62 is mounted upon the nut 40. A continuous chain 64 is disposed in meshing engagement with the sprocket wheels 60, 62. The chain 64 and the sprocket wheels 60, 62 are all in the same plane and are housed in the housing 30 to protect them from weather, dust, and the like.

There are various means that can be provided for coupling a polish rod 52 to the screw 21, such that the polish rod 52 is raised and lowered with the screw 21. The screw 21 is hollow with a central axial bore 22, a load support plate 70 is mounted atop the screw 21 and has a central axial hole 42. A load support plate base 29 is present below the load support plate 70. The polish rod 52 extends up through the bore 22 and the central axial hole of the load support plate 70 and is secured to the screw 21 by a clamp 54 positioned at the top of the load support plate 70. It will be appreciated that the screw 21 does not have to be hollow, the polish rod 52 can be attached to the lower end of the screw 21. One possible disadvantage of doing so would be the height required.

The housing 30 rest on the carrier bar 31, the polish rod 52 passes through the center hole of the carrier bar 31, to enter a well head (e.g., 120; FIG. 9) through a packing gland (122; FIG. 9) and connects to a sucker rod string (56; FIG. 9) as is well known in the art.

The operation of the sucker rod spacing device 10 will now be described. Supplying power to the motor 12 and the motor 12 can rotate, the rotation force of the motor 12 is transferred to the nut 40 through the reducer 14, the sprocket wheel 60, the chain 64 and the sprocket wheel 62. Upon rotation of the nut 40 in a first direction, the screw 21 travels upward, rising the polish rod 52, upon rotation of the nut 40 in a second direction, the screw 21 travels downward, lowering the polish rod 52. The sucker rod string (56) is connected to the polish rod 52, therefore the sucker rod string (56) is raised or lowered with the polish rod 52.

Figure 1:
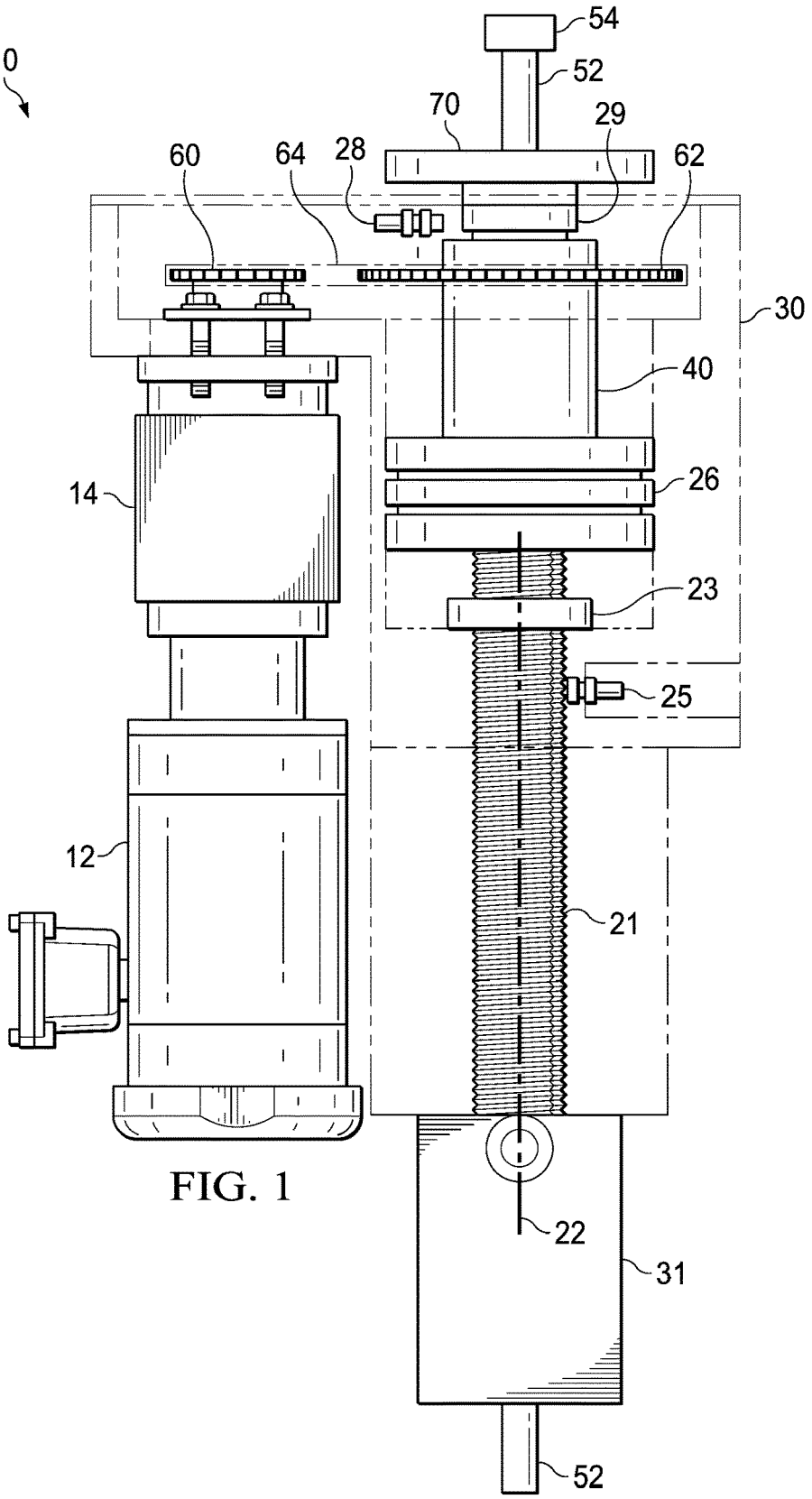
FIG. 1 is a front perspective view of an automated sucker rod spacing device.
Figure 2:
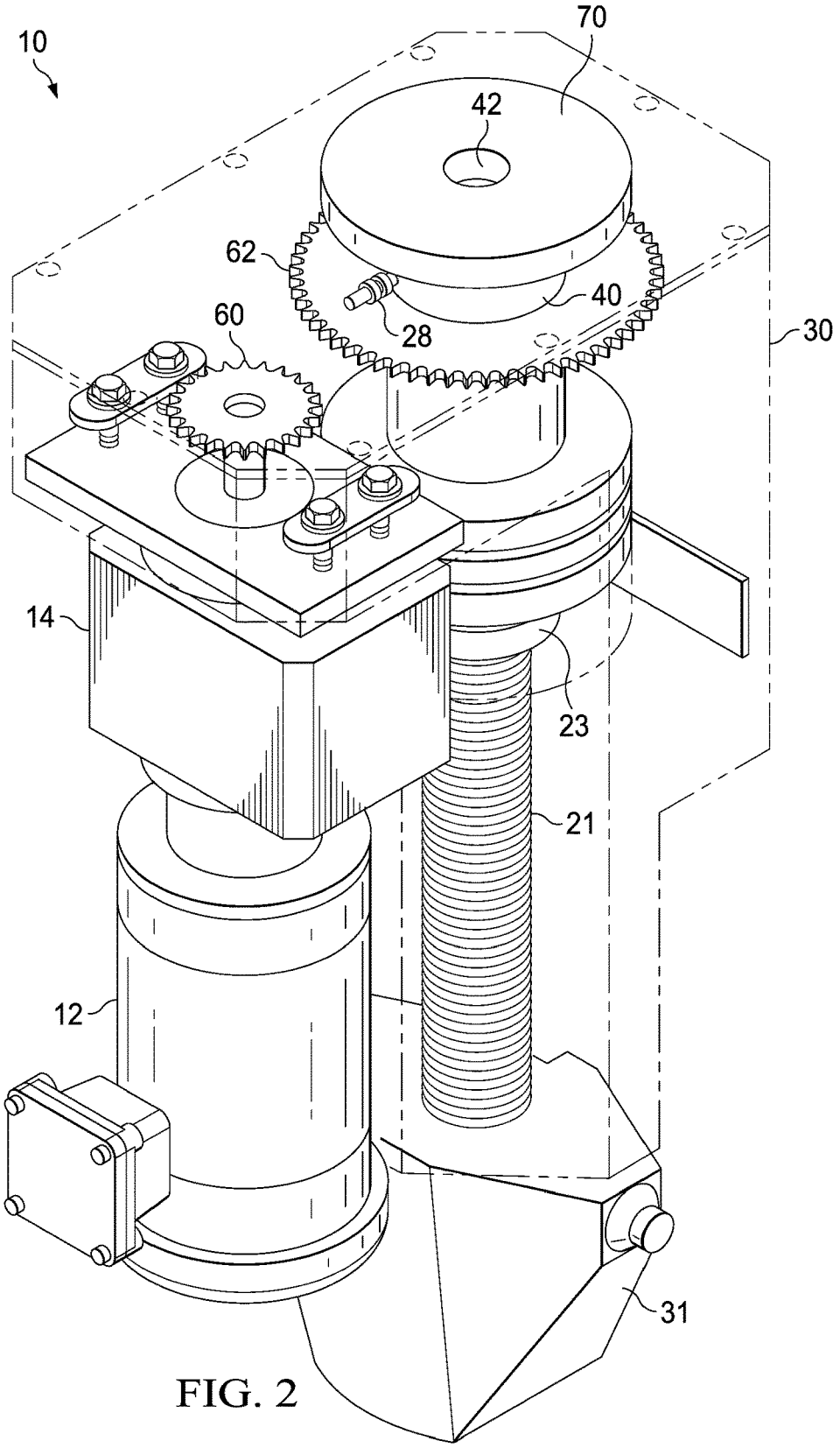
FIG. 2 is a left side perspective view of the automated sucker rod spacing device from FIG. 1.
Figure 3:
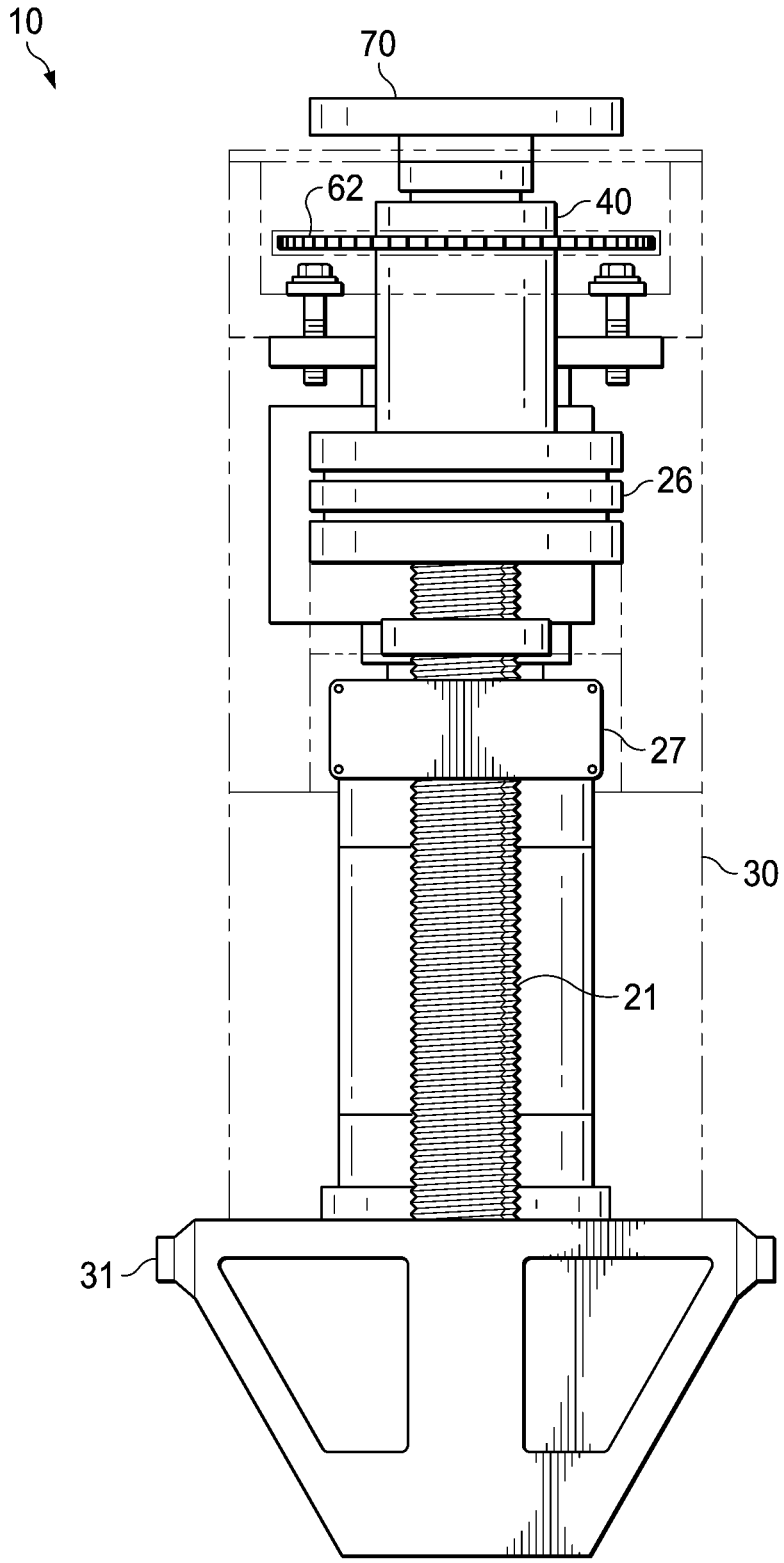
FIG. 3 is a right side perspective view of the automated sucker rod spacing device from FIG. 1.
Figure 4:
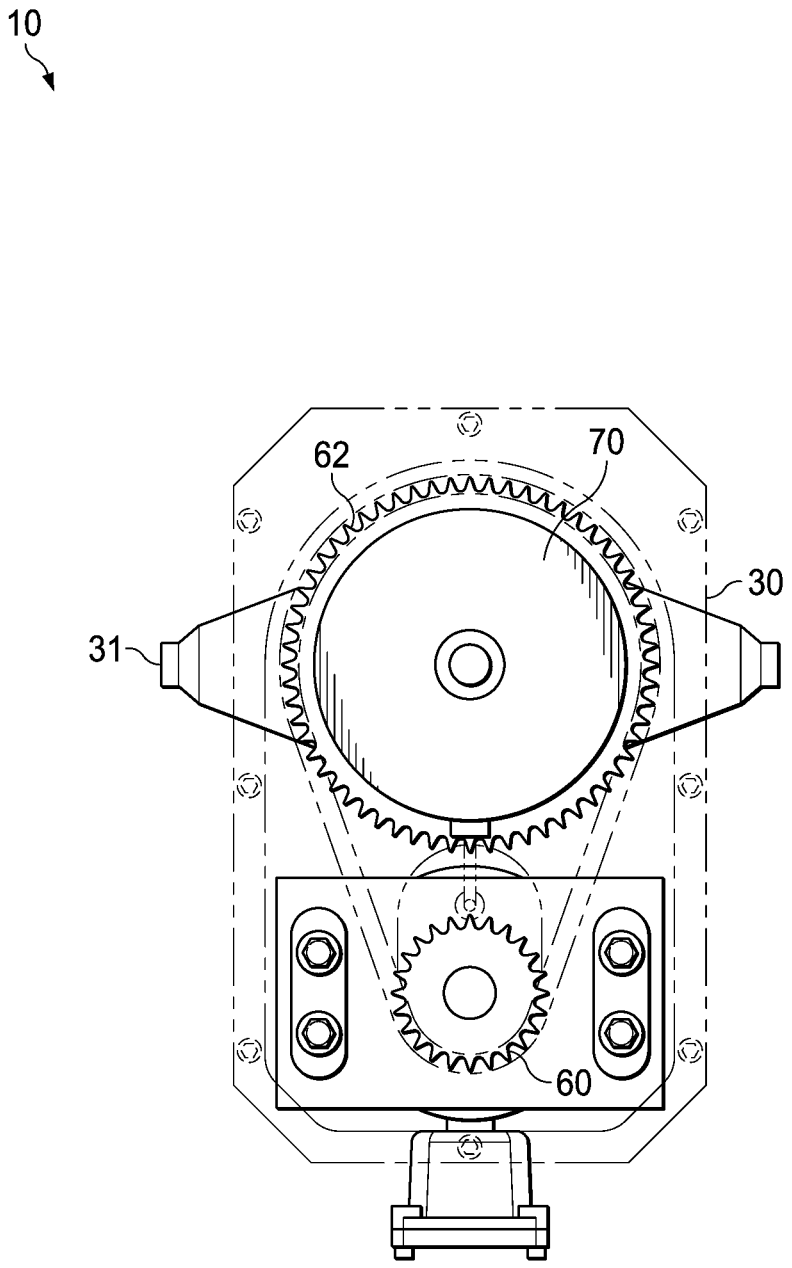
FIG. 4 is a top view of the automated sucker rod spacing device from FIG. 1.
Figure 5:
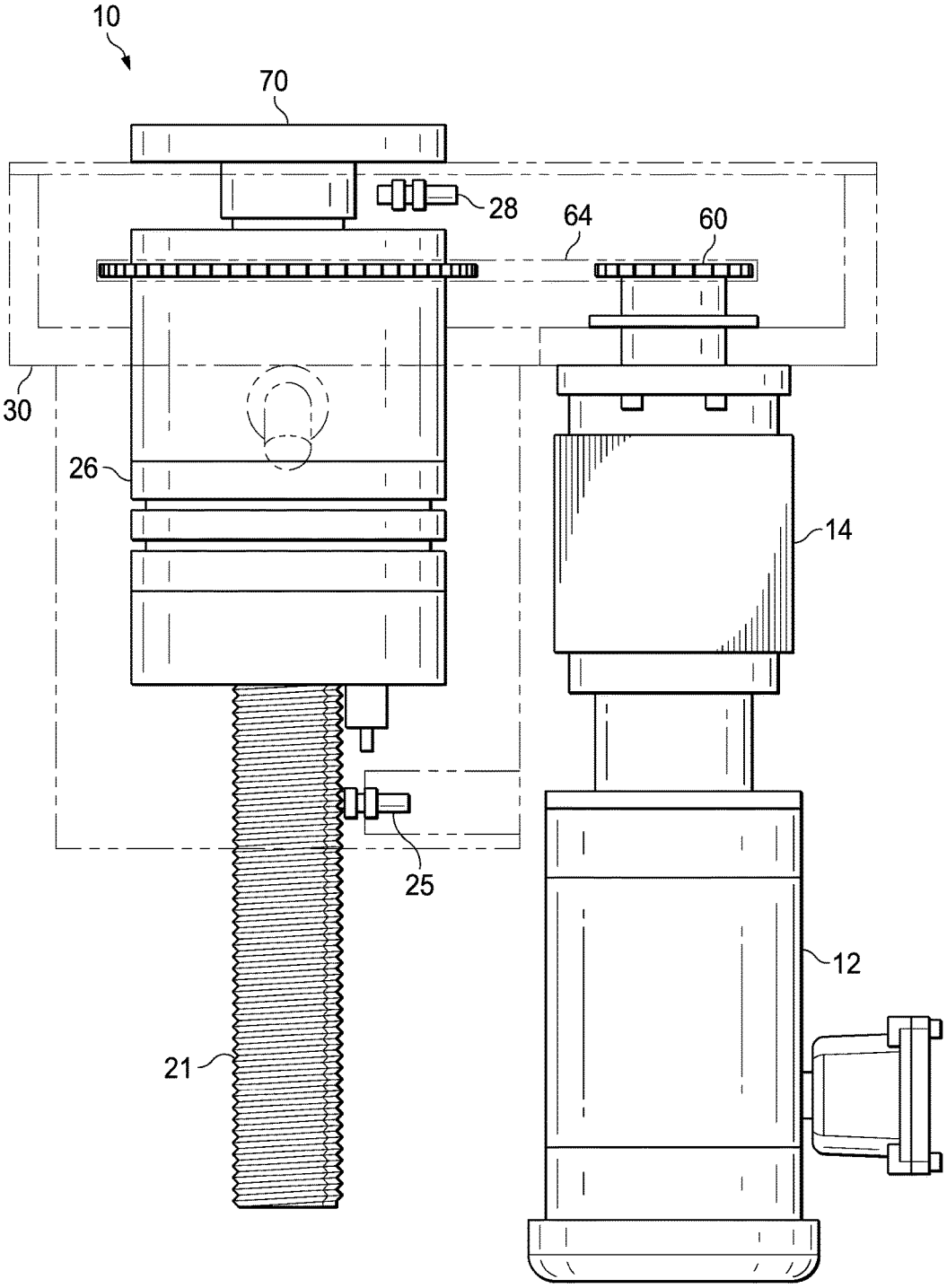
FIG. 5 is a front perspective view of an automated sucker rod spacing device.
Figure 6:
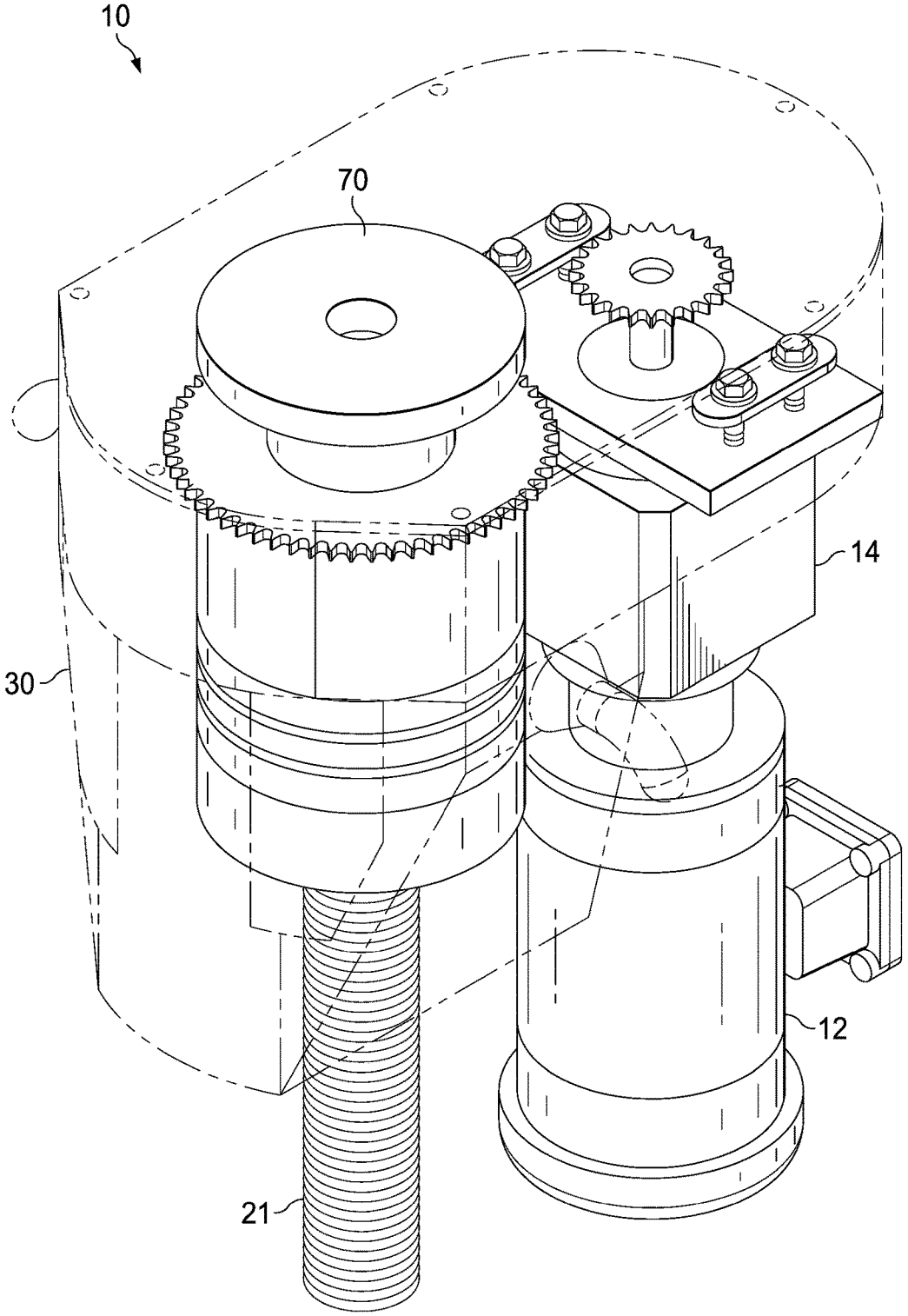
FIG. 6 is a left side perspective view of the automated sucker rod spacing device from FIG. 5.
Figure 7:
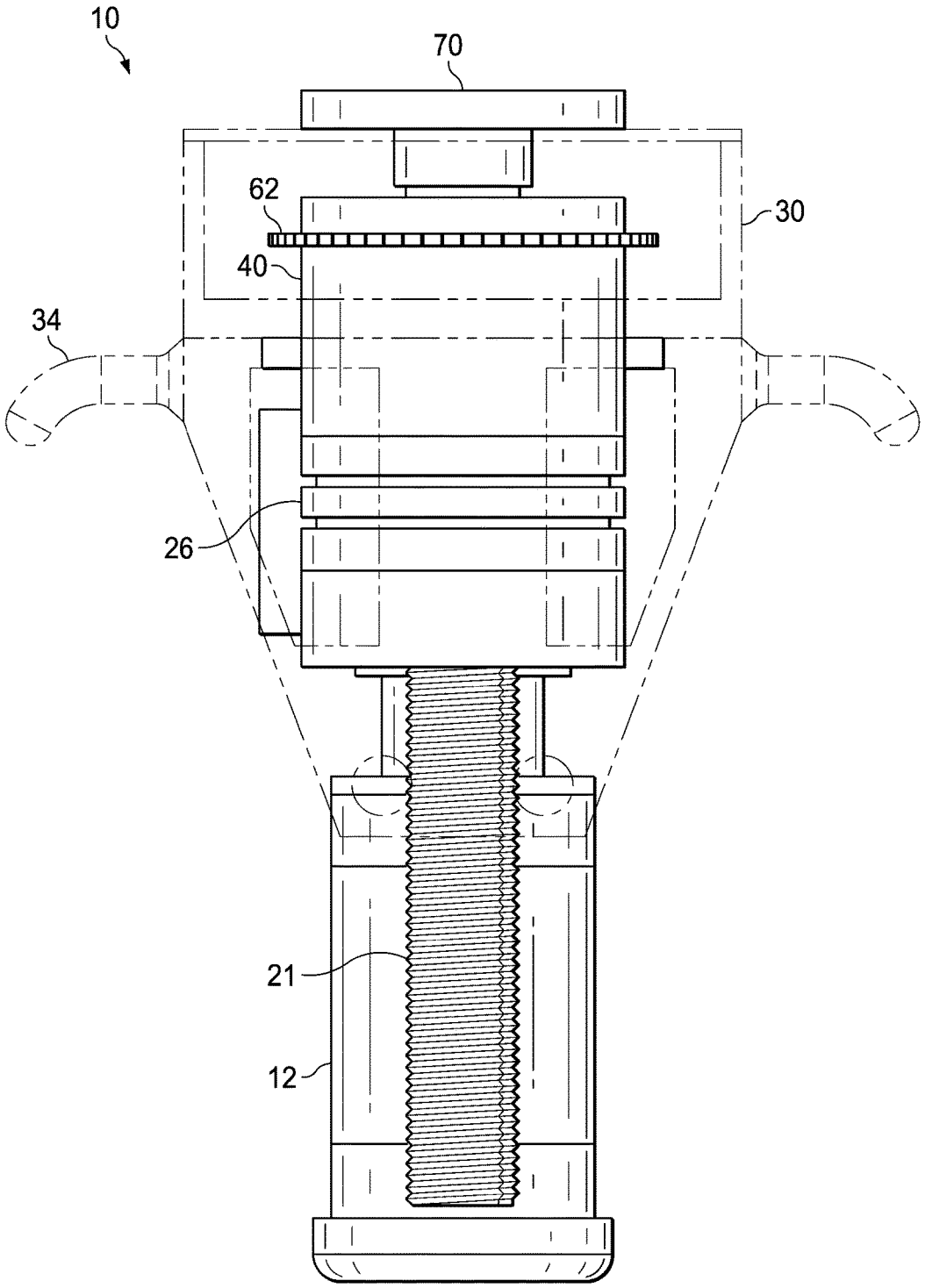
FIG. 7 is a right side perspective view of the automated sucker rod spacing device from FIG. 5.
Figure 8A:
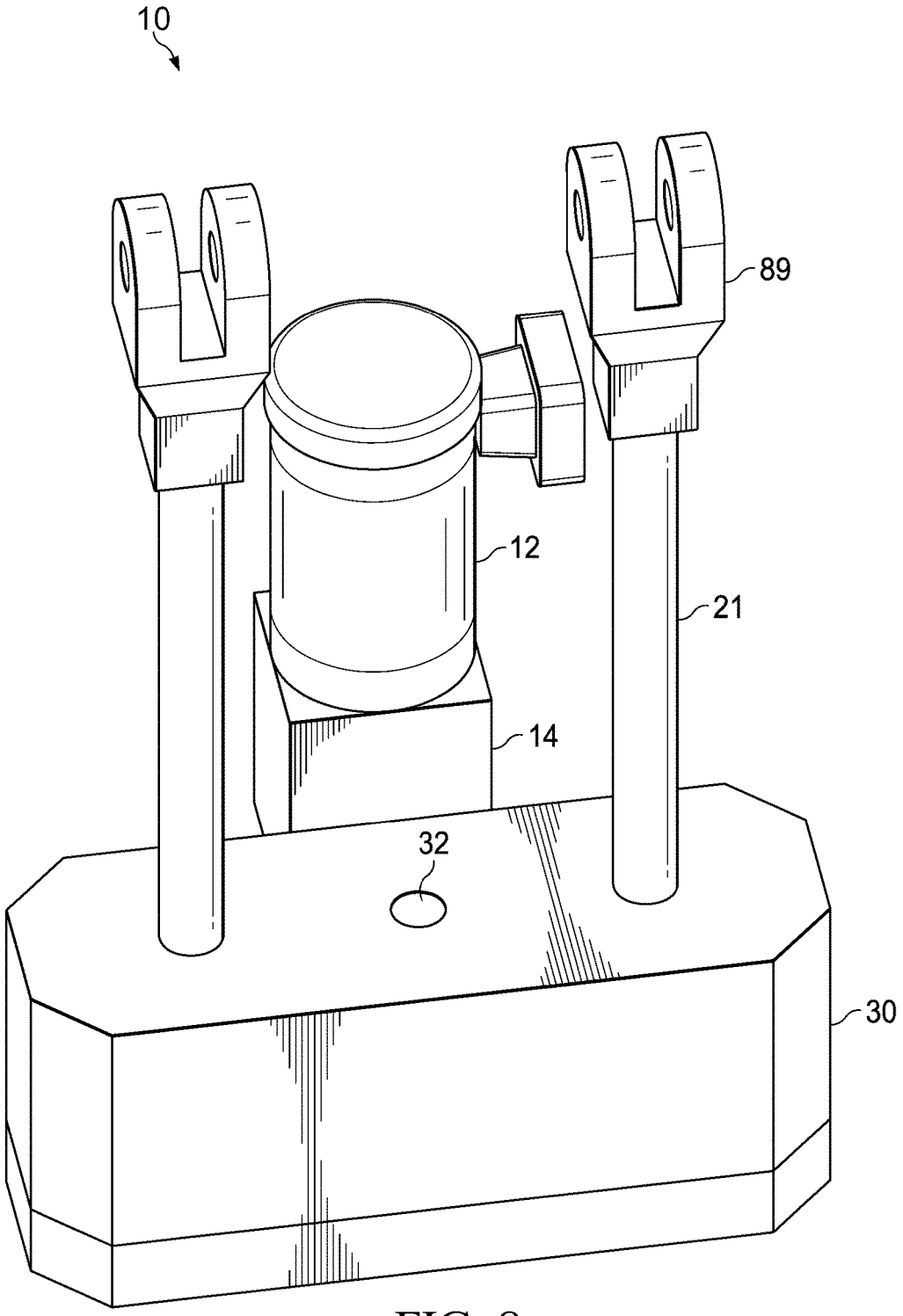
FIG. 8*a* is a front perspective view of an automated sucker rod spacing device.
Figure 8B:
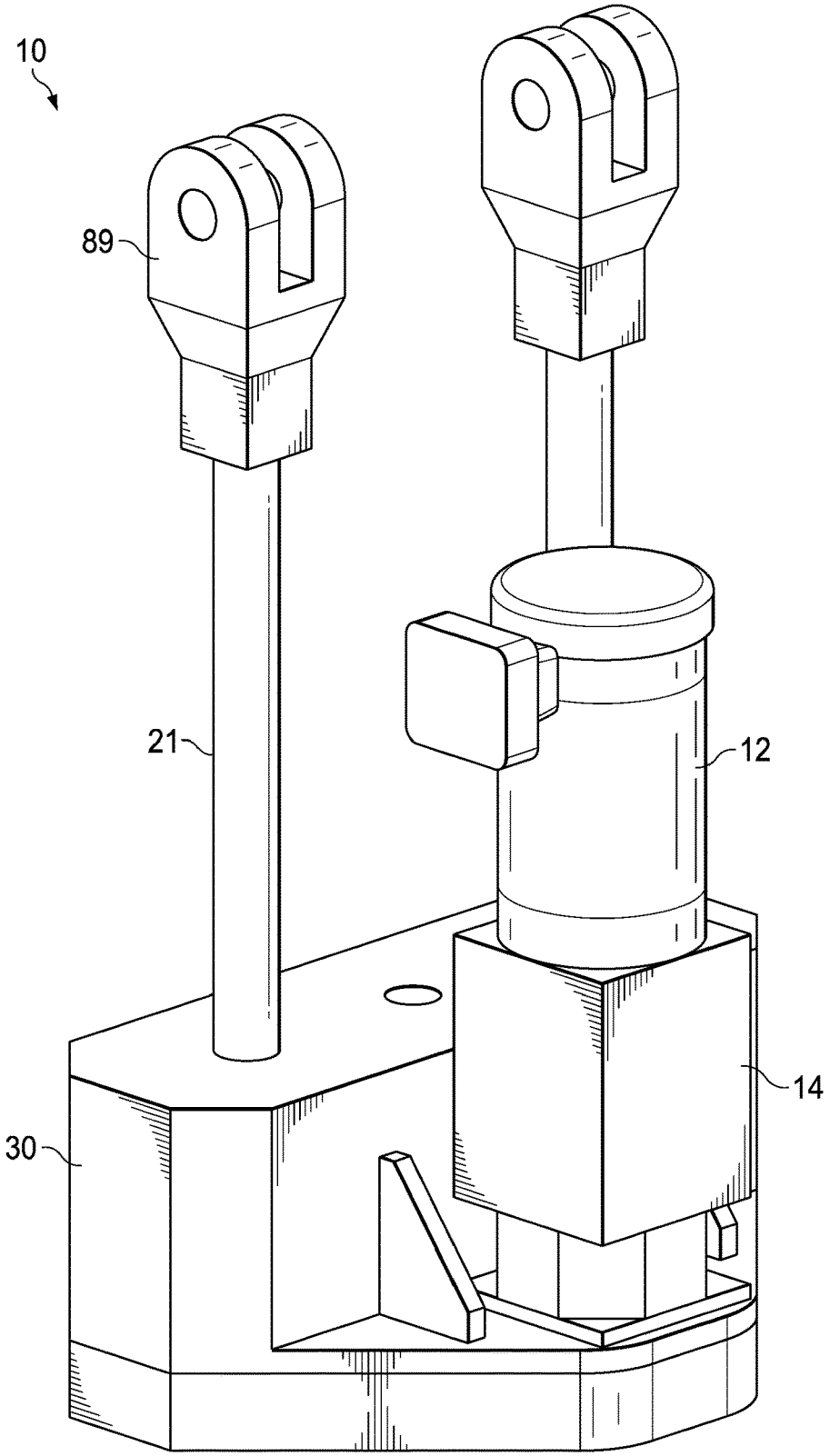
FIG. 8*b* is a rear perspective view of an automated sucker rod spacing device from FIG. 8*a;*
Figure 8C:
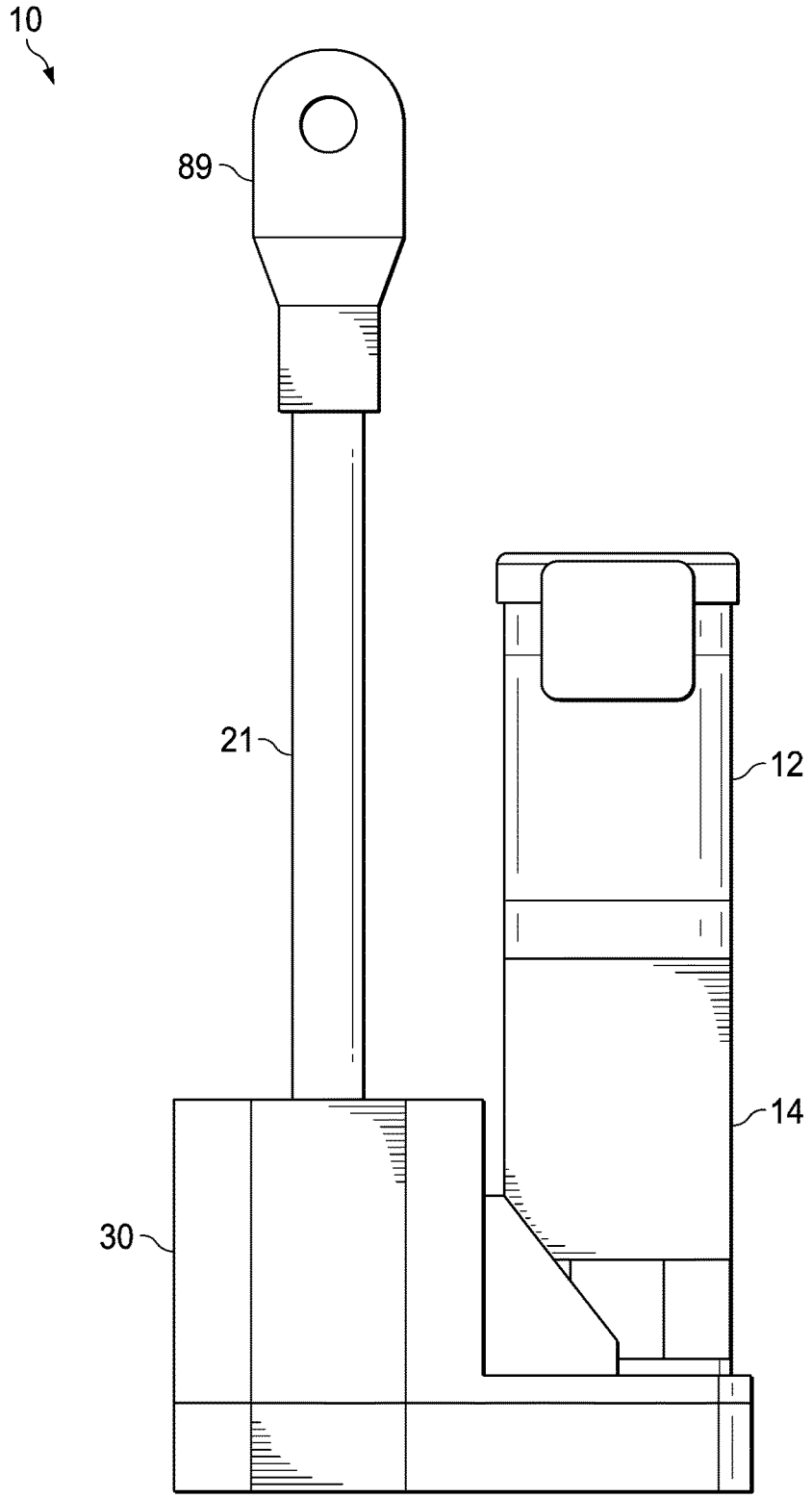
FIG. 8*c* is a side perspective view of an automated sucker rod spacing device from FIG. 8*a;*
Figure 8D:
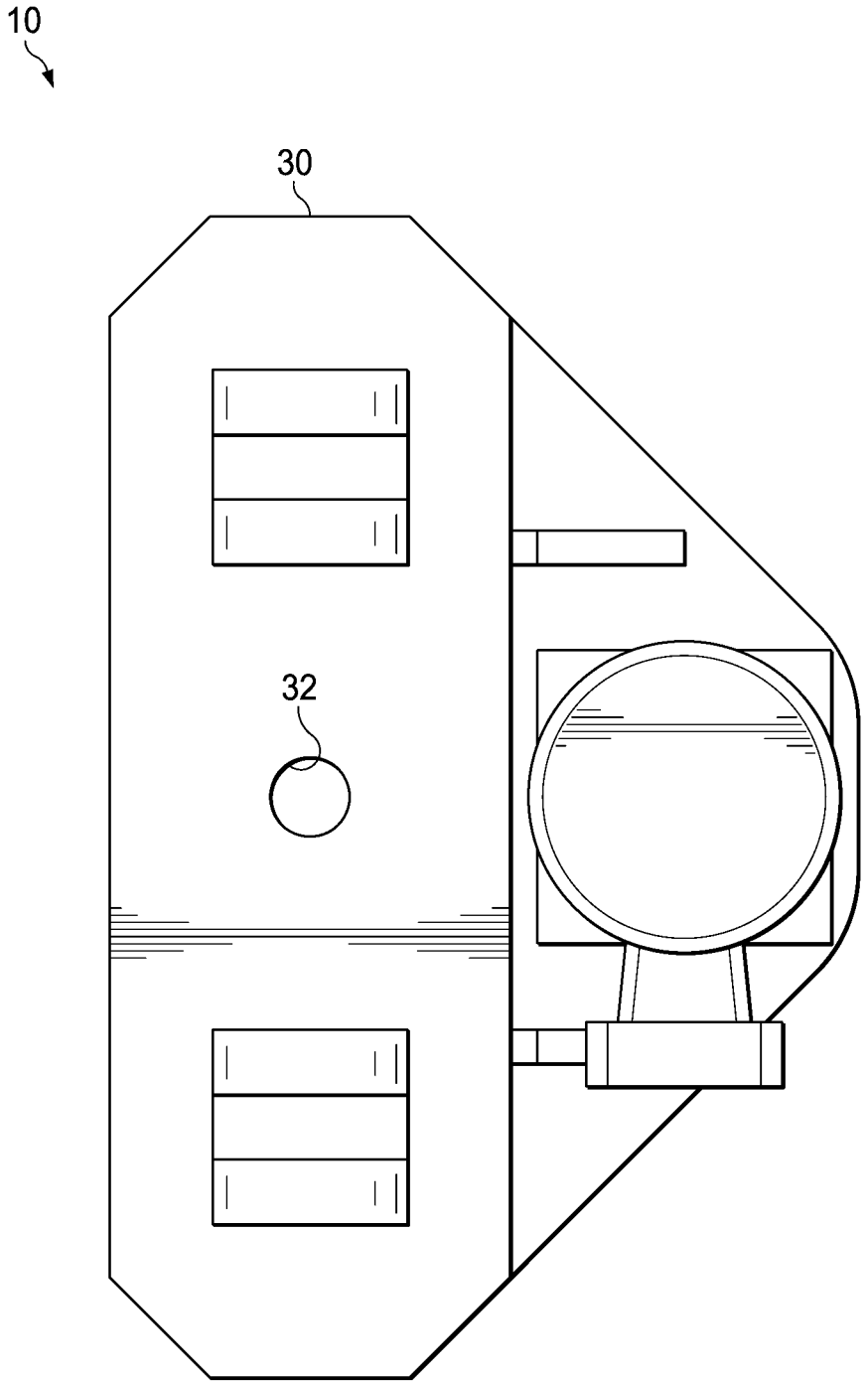
FIG. 8*d* is a bottom perspective view of an automated sucker rod spacing device from FIG. 8*a;*

In another embodiment, referring to FIGS. 5-7, the sucker rod spacing device 10 hooks directly into the carrier bar (not shown) and takes the place of the bridle (not shown). The unit 10 is constructed so that is fits within the current dimensional requirements of the carrier bar. The current carrier bar would be removed from the bridle assembly and the ear hooks 34 would fit into the bridle loops (not shown) just as said carrier bar was designed. The form, fit, and function of the bridle and the attachment of the new equipment will be functionally the same.

In FIGS. 5-7, an automated sucker rod spacing device 10 includes a housing 30 and a screw 21 which is set within the housing 30. Anchored in the housing 30, a nut 40 is in threaded engagement with the screw 21, such that, as the nut 40 rotates, the screw 21 can move upwardly or downwardly. A thrust ball bearing 26 is located below the nut 40. The thrust ball bearing 26 serves to help rotation and to support the nut 40. The nut 40 is advantageously located near the top of the screw 21 in its retracted position to make use of the full length of the screw 21. A motor 12 is provided to supply a rotational force to nut 40. Any kinds of electric motors including an AC motor or DC motor can be used. In an embodiment, the motor 12 is a three-phase induction motor coupled with a motor controller (not shown).

There are various means to transmit a rotation force of the motor 12 to the nut 40. In an illustrated embodiment, the motor 12 is coupled to a sprocket wheel 60 through a rotational reducer 14. The rotational reducer 14 is formed to reduce the rotational speed supplied by the motor 12 and deliver the reduced speed to the sprocket wheel 60. A sprocket wheel 62 is mounted upon the nut 40. A continuous chain 64 is disposed in meshing engagement with the sprocket wheels 60, 62. The chain 64 and the sprocket wheels 60, 62 are all in the same plane and are housed in the housing 30 to protect them from weather, dust, and the like.

The operation of the sucker rod spacing device 10 will now be described. Supplying power to the motor 12 and the motor 12 can rotate, the rotation force of the motor 12 is transferred to the nut 40 through the reducer 14, the sprocket wheel 60, the chain 64 and the sprocket wheel 62. Upon rotation of the nut 40 in a first direction, the screw 21 travels upward, rising the polish rod 52, upon rotation of the nut 40 in a second direction, the screw 21 travels downward, lowering the polish rod 52. The sucker rod string (56) is connected to the polish rod 52, therefore the sucker rod string (56) is raised or lowered with the polish rod 52.

In yet another embodiment, the sucker rod spacing device 10 can be a replacement of the current universal carrier bar (not shown). Referring to FIGS. 8*a*-8*d*, the sucker rod spacing device 10 comprises two screws 21 with ears 89 that will attach to the bridle on the horse's head. As previously described, the screws 21 engage threadedly with nuts, using an electrical motor 12 and a reducer 14, the rotation force of the motor 12 can be transmitted to the nuts via chains, timing belts, or other connecting materials (not shown) in the house 30, a polish rod (not shown) passes through a central hole 32 of the house 30 and is secured to the sucker rod spacing device 10 by a clamp positioned at the top of the house 30. Upon rotation of the nut, the screws 21 can be raised or lowered, such that the sucker rod string (56) is raised or lowered with the polish rod 52.

It should be noted that the motor 12 used here is only exemplary and other means capable of increasing and decreasing the height of the sucker rod string such as hydraulic motor, air cylinders, and manual spacing can be employed.

As noted in the background of the present disclosure and as shown in FIG. 9, a pump jack system 100, which is known by several different names (beam pumping, pumping units, rocking horse, oil jack, jack pump, and many others), is an above ground unit that is used to drive a reciprocating piston pump 150 in an oil well W that is located downhole in the bore of a subterranean formation F. The pumping action is used to mechanically lift wellbore fluids WF from the wellbore W to the surface. The pumping unit 100 operates electrically, whether through standard power or gas generated powered prime mover 102 which turns a crank 104 and moves pitman arms 106 in a pivoting vertical motion. This motion moves a walking beam 108 in proportion to the amount of adjustable movement of the pitman arms 106. A horsehead 110 attaches to the walking beam 108 over a wellhead 120. Suspended from the horsehead 110 is a bridle 112. A polish rod 52 has a polish rod clamp attached to it that holds the position of the rod string 56. The clamp sits on top of a carrier bar. The polish rod 52 goes through a stuffing box 122 and is attached to the rest of the subsurface rod string 56 which is attached to the downhole pump 150. This positioning of the parts allows the mechanical vertical movement of the pumping unit 100 to be transferred to the rod string 56 and to the down pumping system 150. The process of creating the downhole motion of the pumping system 150 can also be created by the use of a vertically mounted hydraulic pumping system (not shown). The hydraulic system, though different on the surface, creates the same motion to the downhole system 150.

The bottom of the well W may be a considerable distance from the surface, necessitating the use of a string of sucker rods 56. The string length/stretch typically changes due to the level of fluid WF in the well W, i.e., the buoyancy effect on the rods 56. In the course of each day, continually changing conditions affect the overall length of the string of sucker rods 56, causing the string 56 to increase or decrease in the length. The change in the length is not entirely predictable. The sucker rods 56 also tend to stretch under operating loads over long periods. Other considerations are that the required adjustment range increases with well depth.

In order to ensure full pump fillage and improve production efficiency, the pump's plunger 152 should be as close to the bottom 157 of the pump's barrel 156 as possible to ensure maximum pump fillage, which may result in the coupling 58 that attaches the pull rod 151 of the pump plunger 152 to the rod string 56 contacting the top of the pump's barrel 156 during the downstroke. This contact of the coupling 58 and the top of the pump's barrel 156 is known in the industry as tagging. This action of tagging causes many destructive effects. It increases the stress on the entire sucker rod string 56. It also causes the sucker rods 56 to buckle and slap the inside of the tubing, which causes increased wear to the sucker rods 56 and the tubing, and begins to start the fatigue process on the rod string 56. Therefore, a compensating adjustment is needed from time to time.

The pump 150 used in connection with the sucker rods 56 can undergo "gas lock". "Gas lock" occurs when gas enters the area below the plunger 152 when the plunger 152 is at the uppermost position of travel in the barrel 156 and while traveling to its lowermost position in the barrel 156, cannot compress the gas sufficiently to force the traveling valve 154 open. On the following upstroke, the gas expands and keeps the pressure high enough below the plunger 152 so that the standing valve 158 will not open and allow fluid to enter the pump barrel 156. This compressing and expanding of gas repeats itself on each downstroke and upstroke without increasing pressure enough to open the traveling valve 154 or decreasing pressure enough to allow the standing valve 158 to open and allow fluid to enter the pump 150. The simple solution to this problem is to periodically adjust the stroking depth of the plunger 152 in the pump's barrel 156 by adjusting the rod string 56. The "lowering" of the rod string 56 can create enough pressure inside the pump 150 to force the valve 154, 156 to open. The lowering of the rod string 56 can also be moved enough so that the coupling 58 on the pull rod 151 strikes the top of the pump 150. This causes vibration in the pump 150 and may shake the traveling valve 154 to allow the gas to escape into the tubing to reduce the "gas lock" condition.

To avoid damage to sucker rods 56 and lost production, the depth of the sucker rod string 56 in the well W should be controlled by lowering or raising the sucker rod string 56 to either stop gas lock or to prevent tagging. Tagging is prevented while at the same time maximum pump fillage is ensured because the plunger 152 is fully engaged.

In an embodiment, in order to automatically control the depth of the sucker rod string 56 in the well W, an automatic control system 80 is used to monitor the pumping operation and control such operation. Referring to FIG. 9, in an embodiment, an accelerometer 81 is mounted on the polished rod 52 and connected through an electrical cable 82 to an electronics package 84. The output from the electronics package 84 is connected through a ribbon cable 85 to a computer 86, the instructions from the computer 86 is connected through a command cable 88 to the controller (not shown) of motor (12) of the sucker rod spacing device 10.

The cables 82, 88 connecting devices 10, 84 in the automatic control system 80 can become damaged, particularly the cable 82 on the polished rod 52 which moves with the polished rod 52. In an alternate embodiment, the electronics package 84 and the controller of motor (12) connect to the computer 86 via wireless communication rather than through cables 82, 88. The electronics package 84, the controller of motor (12) and the computer 86 are formed to be able to send and receive wireless signal. The communication protocol used for these communications is, for example, LIN (Local Interconnect Network) or other relatively low speed communication protocol. However, high speed communication protocol such as CAN (Controller Area Network) can also be used. The advantage of wireless communication includes no need for physical cables, less malfunctions, easy maintenance, and convenience of repair.

In FIG. 9, the accelerometer 81 moves up and down with the polished rod 52 and generates a varying analog electrical signal depending on the state of acceleration it experiences. This analog electrical signal is provided through the cable 82, amplified and converted to digital data within the electronics package 84. The digital data are then provided through the ribbon cable 85 to the computer 86. The computer 86 can then do real-time modeling of what is happening with the sucker rod string 56 downhole. Based on different events encountered, the computer 86 sends commands via the command cable 88 or wi-fi to the controller of motor (12) in sucker rod spacing device 10, the motor (12) can drive the screw (not shown) to raise or lower, thus to shorten or lengthen the overall string 56, whichever is required for optimal production. The system 80 will be monitoring the strings' status in real-time and is capable of making multiple unattended adjustments within minutes.

In an embodiment, the automatic control system 80 can be used to receive and analyze a signal to determine if the sucker rod string 56 is "tagging," or if the pump plunger 152 is hitting the bottom of the pump 150. The computer 86 analyses the data from the accelerometer 81, when there is a sudden change of the acceleration of the accelerometer 81, the computer 86 determines the pump 150 is "tagging," and sends commands to the controller of motor (12) to raise the rod string 56 to a level that stops the "tagging."

It should be appreciated that accelerometer 81 used here is only exemplary and that other means that are capable of sending a signal which is capable of being analyzed to determine if the pump plunger 152 is "tagging" to a computer, such as a load cell (not shown) or a pump off controller 103 can be used.

In another embodiment, the automatic control system 80 can be used to periodically lower the rod string 56 automatically to ensure that there is not too much spacing in the well, ensuring full pump fillage. In this situation, the automatic control system 80 would lower the rod string 56 until it analyzed a slight tag, then slightly raise the rod string 56 to ensure the plunger 152 was close to the bottom, without tagging.

In wells with fiberglass rods installed, the automatic control system 80 would have additional benefits. Fiberglass sucker rods stretch significantly more than steel sucker rods. They are incapable of handling repeated compressive loads. Due to the stretch of the rods, and the inability to handle compression, oil well operators typically install the sucker rods 56 further off bottom than is necessary to ensure they never go into compression. This extra space reduces the amount of production from the oil well, and allows more gas to enter the pump 150, further reducing production and causing damage to the sucker rods 56, pump 150, and tubing. Moreover, the amount of stretch in the fiberglass rods 56 is constantly changing with the fluid level in the well. As a result, the automatic control system 80 would be ideal for fiberglass sucker rod strings 56 to ensure the plunger 152 is close to the bottom of the pump 150 without tagging.

In an embodiment, the automatic control system 80 can be used to avoid gas lock. In this case, the automatic control system 80 would periodically adjust the depth of the rod string 56 to slightly bump the bottom of the well (top of the pump 150, which allows the plunger 152 to come as close to the standing valve 158 as possible) so as to shake any gas bubbles loose.

In an embodiment, the method includes logging data into reports, the data may include the initial position of the sucker rod string 56; the number of adjustments of the depth of a sucker rod string 56; the direction of each adjustment which represents raising or lowering the sucker rod string 56; the distance of each adjustment. The initial position of the sucker rod string 56 can be adopted as a calculating benchmark, when raising or lowering the sucker rod string 56, the value of the initial position adds or decreases the distance of each adjustment, the position of the sucker rod string 56 being in adjustment can then be obtained. The logging further includes the last surface and down hole diagnostic cards.

In an embodiment, the method includes interfacing with the pumping unit or POC 103 to shut down the well when the well has pumped off. This saves energy and prevents damage to the pumping unit 100. There are various methods for detecting pump off. For example, the surface card or down hole card can be used to detect pump off. The surface card can be obtained by measuring the load on the rod 56, measuring the displacement of the rod 56 in a manner correlate with the measurement of the load on the rod 56 and integrating measured load versus displacement to obtain a total power input to the well. The actual load on the rod string 56 can be measured by a load cell (not shown) while the displacement of the rod string 56 can be measured by a beam angle transducer (not shown). When the total power falls below a predetermined minimum, it will be determined that the well has pumped-off.

Typically, there are no sensors to measure conditions at the downhole pump 150, which may be located thousands of feet underground. Instead, numerical methods are used to calculate the position of the pump plunger 152 and the load acting on the plunger 152 from measurements of the position and load for the rod string 56 at the surface so as to obtain a downhole card indirectly. The use of the downhole card eliminates errors caused by ambiguities in the surface card and obscuring effects of downhole friction along the rods 56. The use of the downhole pump card, in addition, permits the controller 103 to detect additional malfunctions of the pumping unit 100 that are difficult to detect when surface cards are used.

In addition to providing for conventional starting and stopping of the pumping unit 100 to control the well, the automatic control system 80 for the device 10 can also control the well by varying the pumping speed. The pumping speed is varied in response to the change in a selected parameter of the surface card or downhole card. The parameter may be the area or portion of the area inside or outside of a downhole card or a surface card. Likewise, the parameter may be the change in the net liquid stroke of the pump 150. In order to change the pumping speed, the pump 100 is powered by an electric motor 102 equipped with a variable frequency drive (VFD). The process of adjusting the pumping speed is thus not an on-off duty cycle process but rather a process that hunts for an optimum pump speed for continuous duty operation that maintains a selected target level. Thereafter, as conditions change, such as an increase or decrease in fluid entering the well, the process will speed up the pump 100 or slow it down to match the condition to keep the desired fluid level target, which can be changed manually or remotely.

Figure 10:
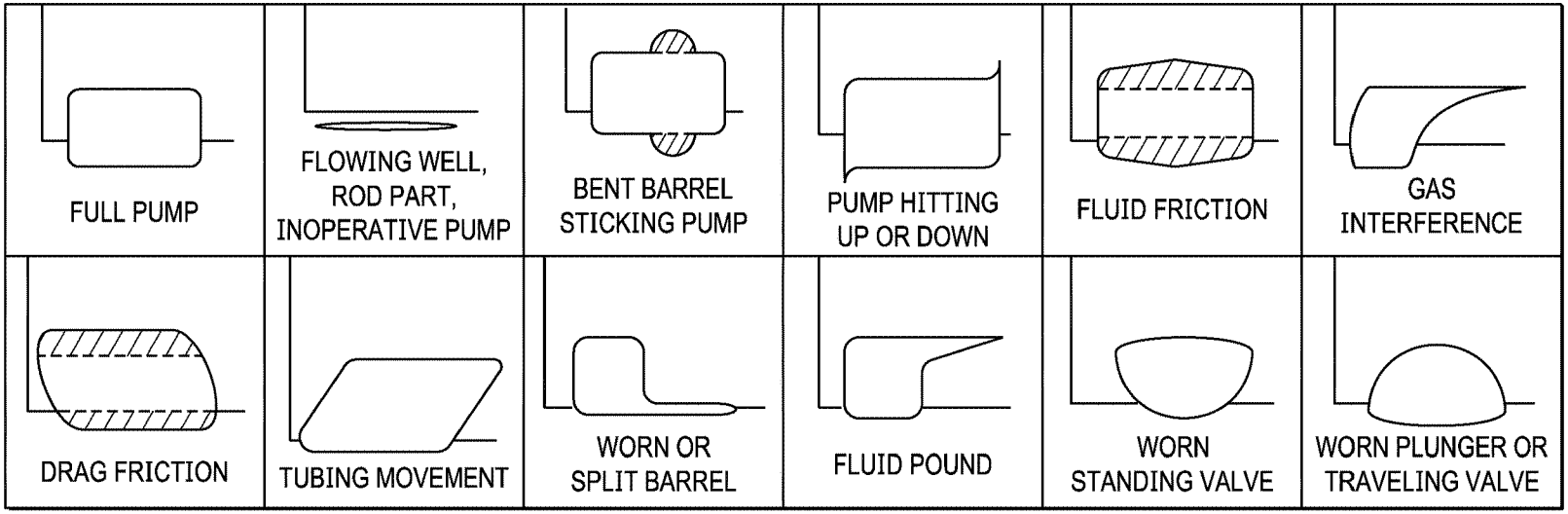
FIG. 10 is a view of different shapes of a downhole card in different conditions.

In an embodiment, the method includes the drawing of surface and downhole card and identification of common cards to identify possible issues. The downhole card can determine what is happening at the pump 150 by interpretation of the shape of the downhole card. Referring to FIG. 10, the possible issues include, but are not limited to, full pump (150), flowing well, rod part, inoperative pump (150), bent barrel (156) or sticking pump, pump plunger (152) hitting up and down, fluid friction, gas interference, drag friction, tubing movement, worn or split barrel (156), fluid pound, worn standing valve (158), and worn plunger (152) or traveling valve (154). In an embodiment, the sucker rod spacing device (10) analyzes the shape of the card, identifies the issue, and adjusts the sucker rod string (56) in a manner to remedy the issue. If the unit (100) cannot correct the issue, a log and notification of possible identified issues can be produced.

In an embodiment of the device 10, system 80, and unit 100 in FIG. 9, the sucker rod spacing device 10 can shut down the unit 100 if operating parameters are not met for programmable period of time. For example, a condition may arise where the pump 150 is not completely filled with fluid on each pump stroke or tagging cannot be adjusted (out of adjustment), which will waste energy or even damage the pumping unit 100.

In an embodiment, the method employs an artificial intelligence system (not shown) that can dynamically keep track of various parameters of the device 10, automatically adjust conditions, give early indications or warnings of failures, and provide suggestions on types of maintenance work required based on the knowledge acquired from previous best practices. Artificial intelligence techniques include but are not limited to the ability to learn from examples, fault tolerant managing of noisy and deficient data, tremendous potential for generating accurate analysis and results from a large historical database, use of the kind of data and individual or engineers may not consider valuable in conventional modelling and analysis processes.

In an embodiment, data is collected from the production wells. In an embodiment, data can be collected from the POC 103. The POC 103 gathers and records periodic well sensor measurements measuring production and well status through load cells (not shown), pressure transducers (not shown), relays (not shown), and motor sensors (not shown). These sensors can record card area, peak surface load, minimum surface load, strokes per minute, surface stroke length, flow line pressure, pump fillage, yesterday cycles, and daily run time, these attributes can be sent over wireless network and recorded in a database.

In an embodiment, an accurate analysis can be generated based on the collected data utilizing including but not limited to artificial neural networks, fuzzy logic, expert systems, generic algorithms, support vector machines, functional network can be used. In an embodiment, "tagging" can be detected using artificial intelligence in the sucker rod spacer device.

In an embodiment, the methods disclosed herein can be implemented as instructions executed by a computer (e.g., computer 86 in FIG. 9). Such computer-executable instructions may include programs, routines, objects, components, data structures, and computer software technologies that can be used to perform particular tasks and process abstract data types. Software implementations of the above described methods may be coded in different languages for application in a variety of computing platforms and environments.

In an embodiment, communication between any components of a sucker rod spacer system, such as user interface, well sensors, database, software, a processor and reporting unit, can be transferred over a communications network. A communications network can be any means that allows for information transfer. A communications network can also include any hardware technology used to connect the individual devices in the network, such as an optical cable or wireless radio frequency. In an embodiment, a communication system such as Bluetooth integration or SCADA compatible system, and/or monitoring of equipment (logs, reports, notification) from a remote location can be realized.

In an embodiment, the method can be integrated into a diagnostic software to export data and produce problem notification. The data can include but is not limited to a surface card, downhole card, entered sucker rod string, entered pump, strokes per minute, run time (24 hours, week, month), calculated production (24 hours, week, month) and variable frequency drive.

In an embodiment, the sucker rod spacing device 10 and method can be utilized to determine pump efficiency. In an embodiment, the device 10 and method can be utilized to determine if there is complete fillage of the pump 150. In an embodiment, the device 10 and method can be utilized to determine if there has been displacement or slippage in the pump 150. In an embodiment, the device 10 and method can log data into reports. In an embodiment, reports can be produced indicating the occurrence of various adjustments performed by the sucker rod spacing device 10. In an embodiment, the number and type of adjustments performed by the sucker rod spacing device 10 are recorded. In an embodiment, the sucker rod spacing device 10 determines whether to increase or decrease the sucker rod string 56. In an embodiment, the production calculations can be recorded and compared to the adjustments performed by sucker rod spacing device 10 to determine the effect on the adjustments on production.

In an embodiment, the sucker rod spacing device 10 is aware of its current location and previous locations. In an embodiment, the sucker rod spacing device 10 logs the diagnostic cards. In an embodiment, the diagnostic cards include but are not limited to surface diagnostic cards and down hole diagnostic cards. In an embodiment, the sucker rod spacing device 10 interfaces with the pumping unit 100 and/or the pump off controller 103 to shut down the well when there is insufficient fluid to pump or a problem with all or a portion of a rod 56.

In an embodiment, there is a user interface to enter information regarding the production rod string and pump for the purpose of calculating the approximate production through a said time period (e.g., 24 hours, 1 week, 1 month).

In an embodiment, the sucker rod spacing device 10 can shut down the unit 100 if the operating parameters are not met for the extent of a pre-programmed period of time. In an embodiment, the operating parameters can include but are not limited to problems with pump fillage and tagging that cannot be adjusted (out of adjustment).

In an embodiment, the sucker rod spacing device 10, sucker rod string 56, and the pumping unit 100 can be monitored from a remote location. In an embodiment, the logs, reports, and notifications can be accessed and reviewed from a remote location.

In an embodiment, the sucker rod spacing device 10 and sensors (not shown) are Bluetooth integrated. In an embodiment, the sucker rod spacing device 10 and sensors are SCADA compatible.

In an embodiment, the data from the sensors allows the production of a surface card and a downhole card. In an embodiment, the sucker rod spacing device 10 is capable of identify common cards in order to identify the cause of an issue with the well.

In an embodiment, the sucker rod sensing device 10 is able to notify a party if there is a problem with the well.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. An apparatus, comprising:

an automatic control system configured to monitor reciprocation of a sucker rod string in a well by a surface pumping unit and configured to determine, based on the monitored reciprocation, an automatic adjustment to a depth of a plunger on the sucker rod string in a barrel of a downhole pump in the well; and a device operably connected to the automatic control system and configured to automatically control the depth of the plunger on the sucker rod string in the well with the automatic adjustment to the sucker rod string in reaction to the determined adjustment, wherein the device is operationally connected between the surface pumping unit and the sucker rod string.

2. The apparatus of claim 1 wherein the device is operationally connected to the sucker rod string by one selected from the group consisting of a polished rod and a sucker rod.

3. The apparatus of claim 1 further comprising a sensor disposed in the well and configured to communicate with a portion of the device located above ground.

4. The apparatus of claim 3 wherein the sensor is selected from the group consisting of load cells, motor sensors, pressure transducers, relays, and accelerometers.

5. The apparatus of claim 1 wherein the device comprises a mechanism configured to lower or raise the sucker rod string mechanically.

6. The apparatus of claim 5 wherein the mechanism is selected from the group consisting of hydraulics, air pistons, and spooling of a bridle between the device and the surface pumping unit.

7. The apparatus of claim 1 wherein the device comprises:

a housing;

a screw set within the housing and connected to the sucker rod string via a polished rod;

a nut which is in threaded engagement with the screw; and a prime mover configured to transmit a rotation force to the nut;

whereby the rotation of the nut can lower or raise the screw and thus lower or raise the sucker rod string.

8. The apparatus of claim 7 wherein the screw comprises:

a central axial bore; and a load support plate mounted on top of the screw, wherein the load support plate comprises a hole;

wherein the polished rod extends up through the central axial bore and the hole of the load support plate; and wherein the polish rod is secured to the screw by a clamp positioned at the top of the load support plate.

9. The apparatus of claim 7, wherein the prime mover comprises: a motor; and a transmission mechanism coupled to the motor.

10. The apparatus of claim 1, wherein the automatic control system comprises: a sensor configured to measure the reciprocation of the sucker rod string; and a computer to control the depth of the plunger on the sucker rod string.

11. The apparatus of claim 10, wherein the sensor is selected from the group consisting of an accelerometer, a strain gauge, and a load cell.

12. The apparatus of claim 10, wherein the automatic control system receives a signal from the sensor and analyzes the signal to determine that the plunger of the downhole pump is tagging against the barrel; wherein in response to the determined tagging, the automatic control system raises the sucker rod string to a level where there is not tagging.

13. The apparatus of claim 1, wherein the automatic control system periodically lowers the sucker rod string until a tag is detected between the plunger and the barrel and subsequently raises the sucker rod string to ensure the plunger of the downhole pump is close to a bottom of the barrel in the well.

14. The apparatus of claim 1, wherein the automatic control system periodically adjusts the depth of the sucker rod string to bump the plunger of the downhole pump on a bottom of the barrel in the well to avoid gas lock.

15. A method of automatically controlling a depth of a plunger, reciprocated on a sucker rod string by a surface pumping unit, in a barrel of a downhole pump in a well, the method comprising:

utilizing the apparatus having the automatic control system and the device of claim 1.

16. The method of claim 15, wherein the method is integrated into a diagnostic software to export data and produce problem notification.

17. The method of claim 15, further comprising monitoring equipment; and producing logs, reports, and notifications from a remote location.

18. The method of claim 15, further comprising utilizing an artificial intelligence system that can dynamically keep track of various parameters of the device, provide early indications of failures, and provide suggestions on types of maintenance work required.

19. The method of claim 18, wherein the artificial intelligence system collects data from a pump-off controller.

20. The method of claim 19, wherein the data is at least one selected from the group consisting of card area, peak surface load, minimum surface load, strokes per minute, surface stroke length, flow line pressure, pump fillage, yesterday cycles, and daily run time.

21. An apparatus for a rod string connected to a plunger disposed in a barrel of a downhole pump in a well, the rod string reciprocated by a surface pumping unit, the apparatus comprising:

a device having a first connection to the rod string and having a second connection to the surface pumping unit, the device having an adjustable spacing between the first and second connections;

a sensor configured to measure a parameter in relation to the reciprocation of the rod string;

a control system in communication with the sensor and configured to determine an adjustment to a depth of the plunger in the barrel based on the measured parameter; and a prime mover in communication with the control system and being configured to adjust the adjustable spacing between the first and second connections of the device in response to the determined adjustment.

22. The apparatus of claim 21, wherein the first connection of the device comprises a screw supporting the rod string at a first point; wherein the second connection of the device comprises a nut threaded on the screw and supported at a second point by the surface pumping unit; and wherein the prime mover is operable to rotate the nut on the screw to adjust the adjustable spacing between the first and second points.

23. The apparatus of claim 22, wherein the first point of the screw supporting the rod string comprises a plate disposed on an upper end of the screw and supporting a load of the rod string thereagainst; and wherein the second point of the nut supported by the surface pumping unit comprises a bearing supporting the nut and supported by a carrier connected to the surface pumping unit.

24. The apparatus of claim 21, wherein the first connection of the device comprises a carrier supporting the rod string at a first point; wherein the second connection of the device comprises one or more screws extending from the carrier and supported at a second point by the surface pumping unit; and wherein the prime mover is operable to adjust a length of the one or more screws extending from the carrier to adjust the adjustable spacing between the first and second points.

25. The apparatus of claim 21, wherein the sensor comprises an accelerometer measuring acceleration as the parameter in relation to the reciprocation of the rod string; and wherein to determine the adjustment to the depth of the plunger in the barrel based on the measured acceleration, the control system is configured to:

detect a sudden change in the measured acceleration associated with tagging of the plunger against the barrel of the downhole pump; and actuate the prime mover to decrease the adjustable spacing of the device, whereby the depth of the plunger is raised.

26. The apparatus of claim 25, wherein to determine the adjustment to the depth of the plunger in the barrel based on the measured parameter, the control system is configured to:

periodically lower the depth of the plunger until a tag is detected between the plunger and the barrel; and subsequently raise the depth of the plunger an extent.

27. A method of controlling a downhole pump in a well having a plunger reciprocated on a rod string by a surface pumping unit in a barrel of the downhole pump, the method comprising:

connecting an adjustable spacing with a first connection to the rod string and a second connection to the surface pumping unit;

measuring, with a sensor, a parameter in relation to the reciprocation of the rod string;

determining an automatic adjustment to a depth of the plunger in the barrel based on the measured parameter; and actuating the adjustable spacing between the first and second connections automatically in response to the determined adjustment.

28. The method of claim 27, wherein connecting the adjustable spacing with the first connection to the rod string and the second connection to the surface pumping unit comprises supporting the rod string at a first point on a screw, and supporting a nut threaded on the screw at a second point by the surface pumping unit; and wherein actuating the adjustable spacing between the first and second connections comprises rotating the nut on the screw with a prime mover.

29. The method of claim 27, wherein connecting the adjustable spacing with the first connection to the rod string and the second connection to the surface pumping unit comprises supporting the rod string at a first point of a carrier, and supporting one or more screws extending from the carrier at a second point by the surface pumping unit; and wherein actuating the adjustable spacing between the first and second connections comprises adjusting a length of the one or more screws extending from the carrier with a prime mover.

30. The method of claim 27, wherein measuring, with the sensor, the parameter in relation to the reciprocation of the rod string comprises measuring, with an accelerometer as the sensor, acceleration as the parameter in relation to the reciprocation of the rod string.

31. The method of claim 30, wherein determining the adjustment to the depth of the plunger in the barrel based on the measured acceleration comprises:

detecting a change in the measured acceleration associated with tagging of the plunger against the barrel of the downhole pump; and decreasing the adjustable spacing, whereby the depth of the plunger is raised.

32. The method of claim 27, wherein determining the adjustment and actuating the adjustable spacing in response to the determined adjustment comprises:

periodically lowering the depth of the plunger until a tag is detected between the plunger and the barrel; and subsequently raising the depth of the plunger an extent.

33. The method of claim 27, wherein determining the adjustment and actuating the adjustable spacing in response to the determined adjustment comprises at least one of:

preventing tagging of the plunger against the barrel of the downhole pump;

periodically optimizing the depth of the plunger in the barrel; and dislodging gas bubbles in the downhole pump by periodically tagging the plunger against the barrel of the downhole pump.

34. The method of claim 27, wherein measuring, with the sensor, the parameter in relation to the reciprocation of the rod string comprises: diagnosing operation of the downhole pump as a function of a downhole card by processing surface data of the surface pumping unit; and analyzing the diagnosed operation, whereby determining the adjustment to the depth of the plunger is based on the analysis.

* * * * *